US010788033B2

(12) United States Patent
Ladrón de Guevara

(10) Patent No.: US 10,788,033 B2
(45) Date of Patent: Sep. 29, 2020

(54) MECHANICAL HYDRAULIC PUMPING UNIT WITH A RADIATOR INTEGRATED

(71) Applicant: SERINPET LTDA REPRESENTACIONES Y SERVICIOS DE PETROLEOS, Bogota (CO)

(72) Inventor: Alejandro Ladrón de Guevara, Bogota (CO)

( * ) Notice: Subject to any disclaimer, the term of this patent is extended or adjusted under 35 U.S.C. 154(b) by 140 days.

(21) Appl. No.: 15/037,933

(22) PCT Filed: Nov. 19, 2014

(86) PCT No.: PCT/IB2014/066176

§ 371 (c)(1),
(2) Date: Jan. 11, 2017

(87) PCT Pub. No.: WO2016/079566

PCT Pub. Date: May 26, 2016

(65) Prior Publication Data

US 2017/0122310 A1 May 4, 2017

(51) Int. Cl.

| | |
|---|---|
| ***F04B 53/08*** | (2006.01) |
| ***F04B 47/04*** | (2006.01) |
| ***F04B 17/03*** | (2006.01) |
| ***E21B 43/12*** | (2006.01) |
| ***F04B 53/10*** | (2006.01) |
| ***F15B 11/08*** | (2006.01) |
| ***F15B 13/04*** | (2006.01) |
| *F15B 21/0423* | (2019.01) |

(52) U.S. Cl.

CPC ..... *F04B 53/08* (2013.01); *E21B 43/126* (2013.01); *F04B 17/03* (2013.01); *F04B 47/04* (2013.01); *F04B 53/10* (2013.01); *F15B 11/08* (2013.01); *F15B 13/0401* (2013.01); *F15B 21/0423* (2019.01); *F15B 2211/20576* (2013.01); *F15B 2211/30525* (2013.01); *F15B 2211/353* (2013.01)

(58) Field of Classification Search

CPC ..... F04B 53/08; F15B 13/025; F15B 21/0423
See application file for complete search history.

(56) References Cited

U.S. PATENT DOCUMENTS

| | | | | |
|---|---|---|---|---|
| 4,276,810 A * | 7/1981 | Zeuner | A01D 41/145 137/596.12 |
| 6,739,129 B2 * | 5/2004 | Heusser | F04B 17/03 60/468 |
| 2013/0209285 A1 * | 8/2013 | Ladron De Guevara Rangel | F04B 7/00 417/279 |

* cited by examiner

*Primary Examiner* — F Daniel Lopez
(74) *Attorney, Agent, or Firm* — Cotman IP Law Group

(57) ABSTRACT

The invention corresponds to a mechanical hydraulic pumping unit with a radiator integrated to the chassis and a hydraulic circuit which allows it to operate with high flow rates and low pressure or with low flow rates and high pressure. This mechanical hydraulic pumping unit with a radiator integrated is used to supply a particular pressurized oil flow to a hydraulic actuator, which in turn lifts the load exerted by a string of rods and lift the hydrostatic column that is inside an oil well. The main feature of this mechanical hydraulic pumping unit with a radiator integrated is that the radiator is part of the machine's chassis and is located in the middle of two hydraulic oil tanks. The first of these tanks is the oil suction tank, while the second is the oil return tank.

1 Claim, 7 Drawing Sheets

Legend:
2 – Fan
3 – Motor
6 – Primary Pump
7 – Secondary Pump
8 – Selector Valve
15 – Flow Connector Legend:
16 – Regulating Valve
17 – Regulating Valve
18 – Check Valve
19 – Solenoid valve
20 – Solenoid Valve
56 – Check Valve

MECHANICAL HYDRAULIC PUMPING UNIT WITH A RADIATOR INTEGRATED

FIELD OF THE INVENTION

The present invention corresponds to a mechanical hydraulic pumping unit with a radiator integrated that has been perfected for its use in the oil production or the hydrocarbons extraction.

In the oil industry, one of the needs that is known is the necessity of operate the oil wells at different speeds and different forces, especially in fields that used steam injection technologies. In these fields, with steam injection technologies, the production has a cold cycle where it requires low speeds and high forces, and also has a hot cycle that requires high speeds and low forces. Therefore, the present invention has oil wells application, where mechanical pumping as an artificial lift system is used.

BACKGROUND OF THE INVENTION

Mechanical hydraulic pumping units are machines that make the artificial lifting of the oil that is in the subsurface, using a hydraulic system composed of a series of independent elements. Usually, three motors are used: one for the power pump, other for the recirculating pump and another for a fan.

In turn, these machines are equipped with an oil tank, a radiator, a hood electrical, a focus puller for the air that drives the fan, and a structure in which are mounted all the components listed above.

Colombian patent invention "Mechanical hydraulic pumping unit with single-motor", it's characterized by having a single motor that is coupled to a dual pump to one of the ends of its shaft and at the back end of the shaft, the fan.

The present invention simplifies even more the design and optimizes the operation of the conventional unit, because to drive both pumps and fan it uses a single motor. Besides its physical structure provides two hydraulic tanks, a radiator, an electrical chest, a hydraulic chest and an electrical controls and hydraulic measuring elements chest, resulting in a more reliable and simple machine. Finally, the machine comprises a speed selector valve in order to operate the wells at high speeds and low forces or at low speeds and high forces.

DESCRIPTION OF INVENTION

The present invention is a mechanical hydraulic pumping unit with a radiator integrated that provides a hydraulic oil flow for a required pressure for starting the hydraulic actuator 48, which comprises the ability to lift the weight generated by a bunch of rod strings in a well, and also lift the hydrostatic column that it is generated during oil extraction. It is characterized by having a chassis 1, a fan 2, a motor 3, a bell 4, a flexible coupling 5, a primary pump 6, a secondary pump 7, a selector valve 8, an oil discharge tank 9, a radiator 10, a suction tank 11, a dry breech 12 for electrical controls and elements of hydraulic measurement, a chest 13 for an hydraulic circuit of power, a coffer 14 for electrical components, a flow connector 15, a pressure regulating valve 16 for the recirculation of oil, a pressure regulating valve 17 for oil return, a flow control check valve 18, a primary pilot solenoid valve 19 for a regulating valve 16, a secondary pilot solenoid valve 20 to a regulating valve 17, an hydraulic oil suction filter 21, a ball valve 22, a pressure gauge of the recirculation circuit 23, a pressure gauge of the power circuit 24, a thermometer 25, a line 26 for the connection between power circuit and pressure gauge 24, a line 27 for the connection between the return line 36 and the pressure gauge 23, a viewer and level sensor 28, a line 29 for the connection between the pilot solenoid valve 20 and the pressure regulating valve 17, a line 30 for the connection between pilot solenoid valve 19 and flow regulator valve 16, a check anti-return 31, a hose 32 for the connection between the primary pump 6 and the connector flows 15, a hose 33 for the connection between the secondary pump 7 and the selector valve 8, a hose 34 for the connection between the selector valve 8 and the flow connector 15, a hose 35 for the connection between the selector valve 8 and the return line 36, a return line 36 for the hydraulic oil, a hose 37 for the connection between the pressure regulating valve 17 and return line 36, a hose 38 for the connection between pressure regulating valve 16 and return line 36, a cover 39 of the return tank, a cover 40 of the oil suction tank, a cover 41 for the dry bedroom 40, a cover 42 for the coffer 13 and a cover 43 for coffer 14, an air filter 44 for suction tank 11, a lateral cover 45 of the chassis 1, a hatch 46 of the lateral cover 45, a pedestal 47, a hydraulic actuator 48, a superior sensor 49, an inferior sensor 50, an electrical control panel 51, a high pressure ball valve 52, a hose 53 that connects the hydraulic circuit of power with the high pressure ball valve 52, a hose 54 to connect the pedestal 47 to the hydraulic actuator 48, a return line 55 that connects the hydraulic actuator 48 to suction tank 11, a high pressure check valve 56, an electronic card control 57, a suction rack 58 for air, a grid for the left lateral discharge 59 for air and a grid for the right discharge 60 for air.

The mechanical hydraulic pumping unit with a radiator integrated to the chassis has a dual pump that takes oil from the suction oil tank. This dual pump is driven by a motor that is coupled through a fan and a flexible coupler. In turn, the rear axle of the motor comprises a fan, which sucks air from the outside and then forces the air to the inside of the machine passing through the hydraulic oil cooler radiator, which is located above the motor and between the two oil tanks. Once the dual pump has sucked hydraulic oil, the first discharge of the hydraulic oil that correspond to the primary pump, of the dual pump, is sent to the hydraulic power circuit, while the second discharge of hydraulic oil that correspond to the secondary pump, of the dual pump, is sent to a selector valve. The selector valve offers the option of sending the secondary pump oil to the hydraulic power circuit or otherwise sends the oil to the oil discharge tank. This allows the two hydraulic flows belonging to the primary and secondary pump, or otherwise, that the oil belonging to the primary pump is sent to the hydraulic circuit and that the secondary's oil pump is recirculated to the discharge tank.

Additionally, this invention is characterized by integrating an electrical coffer, a hydraulic coffer and an electric control coffers with hydraulic measuring elements, to the machine's chassis. In this way this machine has advantages because the machine's volume is reduced, and the system reliability is increased while this has fewer parts and connections, both hydraulic and electrical, that are duly protected of the environment.

The hydraulic power circuit comprise the regulating pressure valve 16, the regulating pressure valve 17, the high pressure check valve 56, the primary pilot solenoid valve 19, the secondary pilot solenoid valve 20 and the check regulating flow valve 18, as shown in FIGS. 6 and 7. Additionally, the machine's chassis 1 is constructed with a feature geometry which places the radiator 10 at the top of the machine in the middle of the oil discharge tank 9 and the suction tank 11 as the FIGS. 3 and 4 shown. Also, the chassis of the dry breech 12 is located at the same height and next to the suction tank 11 as the FIG. 4 shows. Under the dry breech 12 and the suction tank 11, is the coffer 13 and under this, is the coffer 14 as the FIG. 4 shows. Thus, an air focuser is created for the contained volume that is between the chassis' base 1, the breech's walls 13 and 14, the inferior part of the oil discharge tank 9 and the lateral cover 45 with the respective hatch 46, as shown in the FIGS. 2, 3 and 4.

When the motor 3 is energized, its shaft rotates. The shaft, in its rear end has a fan 2, so the fan can suck the outside air through the screen of air suction 58 into the air focuser that directs the flow to the top of the machine, forcing air through radiator 10 to finally exit through the lateral screens 59 and 60, as shown in FIG. 4. In the front end of the shaft of motor 3 is a flexible coupling 5, which transfers the torque and shaft rotation to the dual pump, as shown in FIGS. 4 and 5. This dual pump is located in the center and is attached to the bell 4, which in turn is attached to the motor 3 and also centered on the motor 3's shaft, ensuring an excellent alignment between the dual pump shaft and motor 3's shaft. Further, the dual pump is composed of a primary pump 6 and a secondary pump 7 that share a single suction. This suction is connected to the ball valve 22 which in turn is connected to the hydraulic oil suction filter 21 which is located inside the suction tank 11, as shown in FIGS. 4 and 5. Thus, the oil present inside suction tank 11 is sucked by the primary pump 6 and secondary pump 7. The primary pump 6 pressurizes the oil flow and sends it through the hose 32 into the flow connector 15, as shown in FIG. 5. Thereafter, the oil is sent to the hydraulic power circuit, as shown in FIG. 6. On the other hand, the oil sucked by the secondary pump 7 is pressurized by this to the hose 33 which connects it with selector valve 8, as shown in FIG. 5. When the selector valve 8 is in speed one, the hydraulic oil returns to discharge tank 9 through the hose 35 and the return line for the hydraulic oil 36 that has the non-return check 31, as shown in FIGS. 5 and 6. When the selector valve 8 is in speed two, the oil that comes from the secondary pump 7 is sent through hose 34 so that it enters to the flow connector 15 adding the flow rates coming from the main pump 6 and the secondary pump 7, as shown in FIGS. 5 and 6.

In any speed, one or two, the oil that is in the flow connector 15 is sent to the hydraulic circuit. The path that the oil cruises in this case is through the pressure regulating valve 16, where a first small flow derived via line 30 to the primary pilot solenoid valve 19, where it returns to the suction tank 11, a second oil return flow drifting through the hose 38 to the return of the hydraulic oil 36 and a third flow drift the high pressure check valve 56, as shown in FIG. 7. From this high pressure check valve 56, the oil passes to the pressure regulating valve 17 where a first small flow drifts through the line 29 to the secondary pilot solenoid valve 20, which returns to the suction tank 11, a second return flow of oil derived through hose 37 to the return line 36 for the hydraulic oil and a third flow drift to the check flow valve 18, as shown in FIG. 7. Subsequently, the oil passes the hose 53, the high pressure ball valve 52, the pedestal 47, the hose 54, finally reaching the hydraulic actuator 48, as the FIG. 1 shows. When the hydraulic oil reaches to the hydraulic actuator 48, the oil is under low pressure because the primary 19 and the secondary 20 pilot solenoid valves, in a respective shape, are normally open. When the primary 19 and the secondary 20 pilot solenoid valves are open they are not energized allowing that the pressure control valves 16 and 17 remain open by sending the remaining oil through hoses 38 and 37 and from these to the hydraulic oil return line 36. Subsequently, the inferior sensor 50 sends an electric signal to the electronic control card 57, which is responsible for energizing and closing the primary 19 and the secondary 20 pilot solenoid valves. When the primary 19 and the secondary 20 pilot solenoid valves are closed, the hydraulic oil flow stops through lines 29 and 30, allowing pressure control valves 16 and 17 to close at their maximum set pressure. If the pressure required by the hydraulic actuator 48 to lift the load exerted by the rod string and the hydrostatic column that is in the well, is lower than the pressure of the pressure control valves 16 and 17, the hydraulic actuator 48 will start an upward movement because 100% of the hydraulic oil flow enters into this. If the pressure required by the hydraulic actuator 48 to lift the load exerted by the rod string and the hydrostatic column into the well, is greater than the set pressure of the pressure control valves 16 and 17, the hydraulic actuator 48 will remain static and pressure regulating valves 16 and 17 will relieve the pressure of the fluid through hoses 37 and 38, discharging oil into the return line for hydraulic oil 36. In this case it is necessary to adjust to a higher set pressure in the pressure control valves 16 and 17, thereby forcing the hydraulic oil flow to be directed to the hydraulic actuator 48.

When the hydraulic actuator is in the upper position, the superior sensor 49 sends an electric signal to the control card 57 to shut down the primary 19 and the secondary pilot solenoid valves. This superior sensor 49 is located in the upper end of pedestal 47, as shown in detail an of FIG. 1. in this way, by turning off the primary 19 and the secondary pilot solenoid valves which are going to return to their normally open position allowing the passage of fluid through lines 30 and 29, and hoses 38 and 37. Thus the pressure within the pressure control valves 16 and 17 drops to a minimum pressure generated by frictional losses present in the hoses 37 and 38 and in the return line for hydraulic oil 36. This fact forces the pressurized oil within the hydraulic actuator 48 to return to the check valve flow regulator 18 which controls the downward graduates and speed of the hydraulic actuator 48. Subsequently the oil passes from the regulating flow check valve 18 to the pressure regulating valve 17 to be discharged through the hose 37 to the return line 36 and finally to the oil discharge tank 9. This is possible since the high pressure check valve 56 prevents the passage of hydraulic oil to the pressure regulating valve 16 so that protects a possible saturation by high oil flow. Moreover, the oil from the pump passes through the dual pressure regulator valve 16 to hose 38 to reach the return line for hydraulic oil tank 36 toward the oil discharge tank 9. When the hydraulic actuator 48 reaches the lower position, the inferior sensor 50 sends an electrical signal to the electronic control card 57 in order to start a new cycle by closing the primary 19 and the secondary pilot solenoid valves. The pilot inferior sensor 50 is located at the lower end of the pedestal 47, as FIG. 1 shows in the B detail.

The dry breech 12 for electrical controls and elements of hydraulic measuring therein comprises a high pressure gauge 24 of the power circuit, which is connected via line 26 to discharge the hydraulic power circuit, as the FIGS. 3 and 7 shown. Thus, the manometer 24 measures the pressure in the upward and downward movement of the hydraulic actuator 48. In this dry breech 12 there is a manometer recirculation circuit 23 which is connected through the line 27 with the line 36 back to hydraulic oil, as the FIGS. 3 and 7 shown. Thus, the manometer 23 measures the pressure fluctuations within the return line for hydraulic oil 36, as the FIGS. 3 and 7 shown. Additionally, the dry breech 12 comprises a thermometer 25 which measures the temperature of the hydraulic oil into the suction tank 11, and a viewfinder and level sensor 28 to ensure optimum oil level inside the suction tank 11, as the FIG. 3 shows. Finally, the dry breech 12 comprises an electrical control panel 51 which has an emergency stop button and the necessary pushers and for switching on and off the motor 3, and as turning on and off the hand of the primary 19 and the secondary pilot solenoid valves, as the FIG. 3 shows.

The hydraulic oil is cooled when it passes through the inside of the radiator tubes 10. The energy required to achieve this fluid movement is provided by the small height difference of levels between the oil discharge tank 9 and the suction tank 11, as the FIG. 4 shows. Since the dual pump draws oil through the oil filter 21, located inside the suction tank 11, and the ball valve 22, it generates a height level decrease of the suction tank 11 in regard to the high level of the oil discharge tank 9, as the FIG. 4 shows. The frictional losses that are inside of the radiator 10 are less than the small difference of heights between the tanks 9 and 11 levels, because the radiator 10 comprises a short length and a large transverse flow area.

The chassis 1 features a number of lids that seal and protect from environment the components that are inside it. The lid 39 seals the oil discharge tank 9, as the FIG. 2 shows. The lid 40 have incrusted an air filter 44 and connects to line 55 of the return hydraulic oil that is in the hydraulic actuator 48, seal the suction tank 11, as the FIGS. 1 and 2 shown. The cover 41 seals the dry breech 12 to protect the electrical controls and the measurement hydraulic elements, as the FIG. 2 shows. The cover 42 seals the hood 13 to protect the hydraulic power circuit, as the FIG. 2 shows. Finally, the cover 43 seals the coffer 14 to protect the other electrical components, as the FIG. 2 shows.

LIST OF REFERENCE

Figure 1:
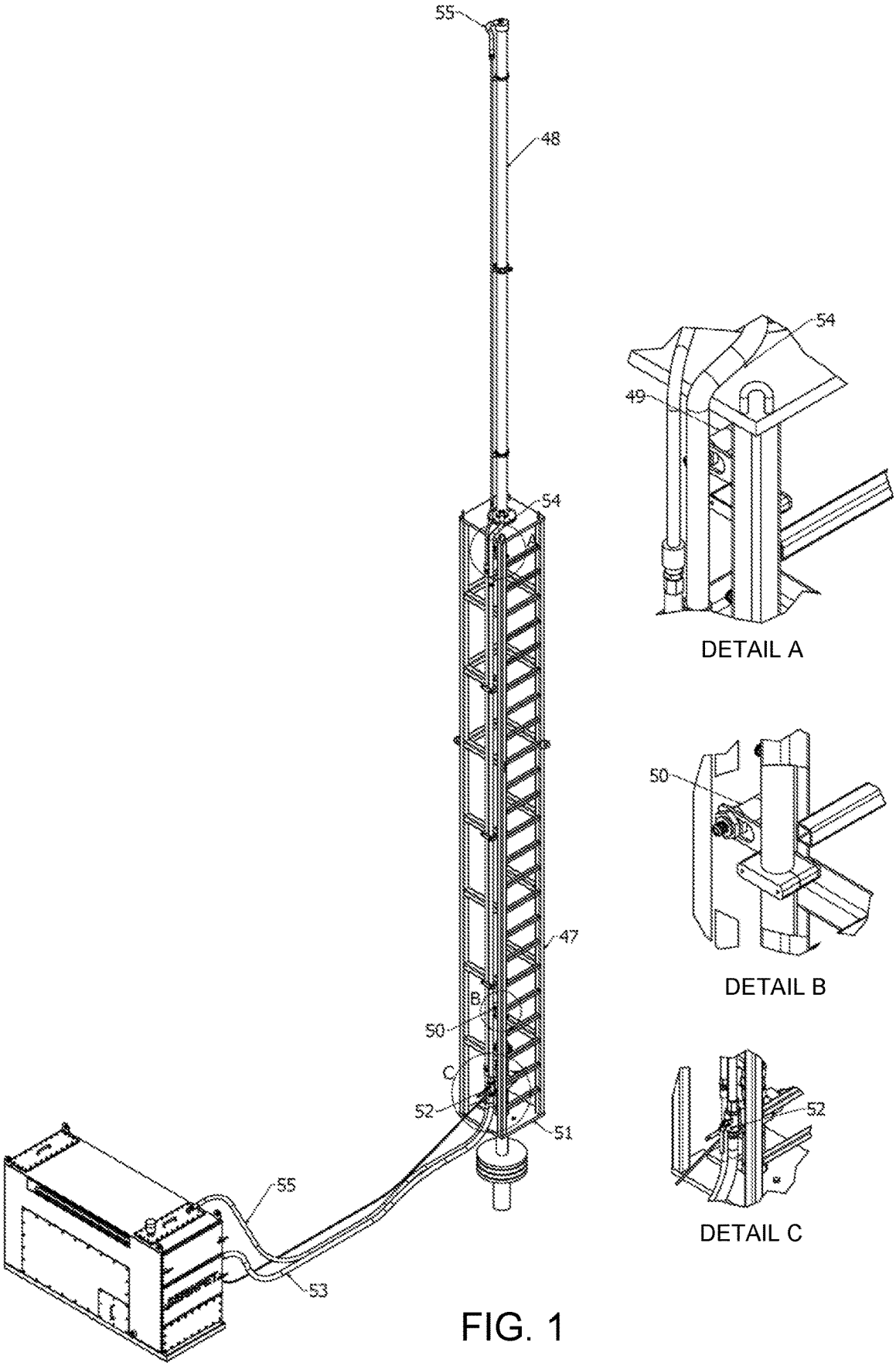
FIG. 1 is a perspective view of the hydraulic power unit, the pedestal and the hydraulic actuator. With an A detail of the superior sensor 49 and hose 54, detail B of the inferior sensor 50, detail C of the valve high pressure ball 52.
Figure 2:
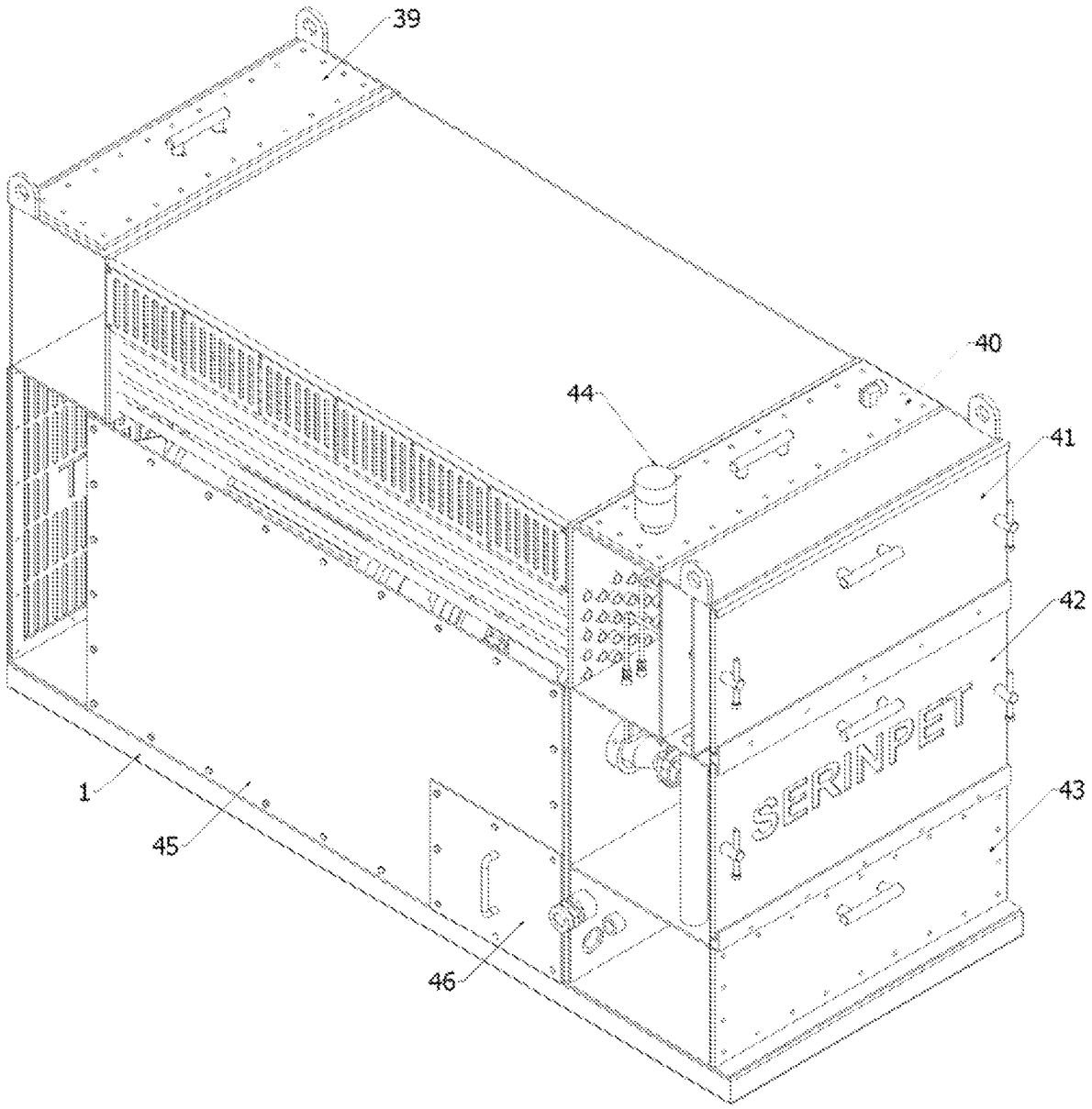
FIG. 2: is a perspective view of the hydraulic power unit where all external covers are observed.
Figure 3:
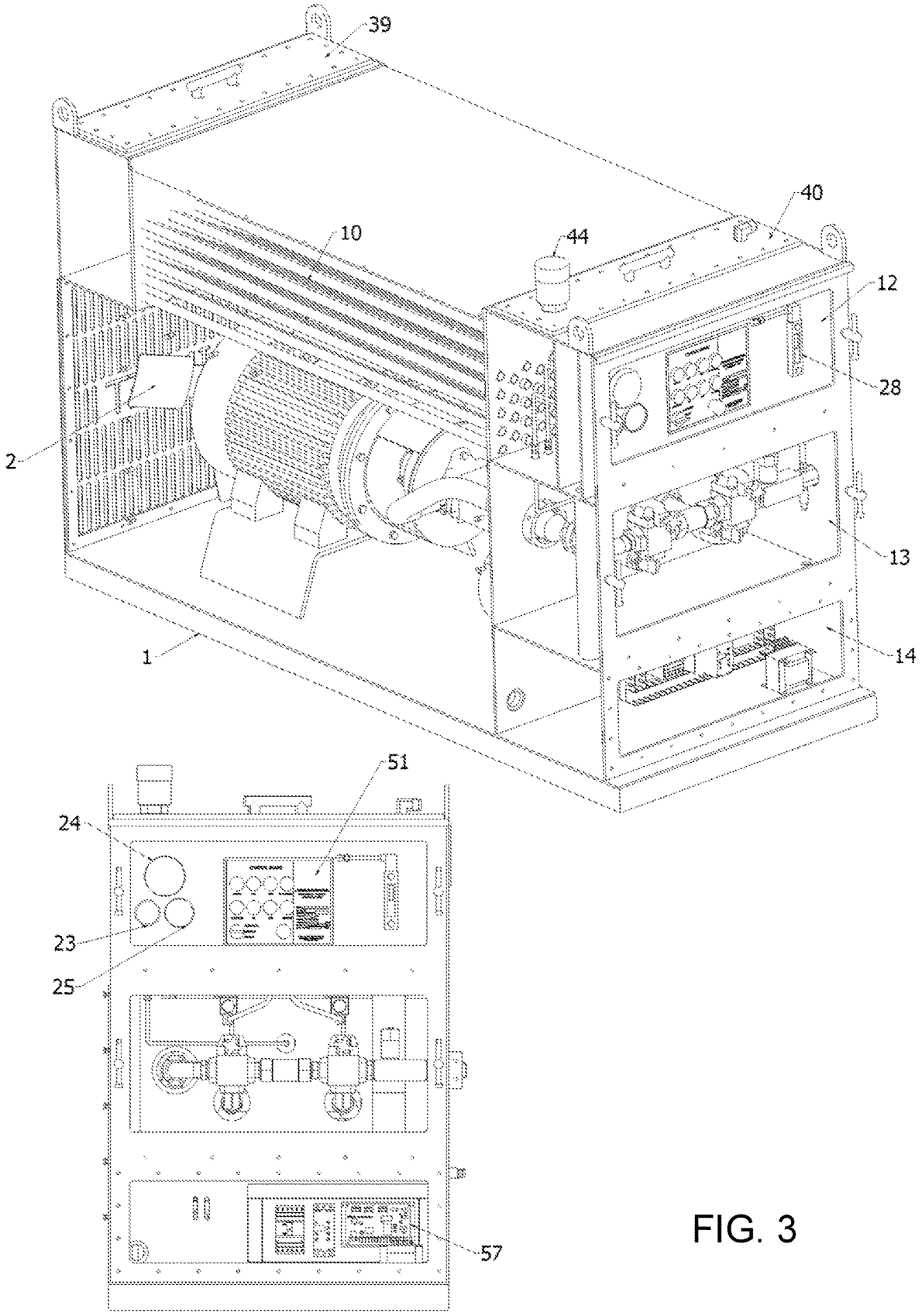
FIG. 3: is a perspective view of the hydraulic power unit where internal components are observed.
Figure 4:
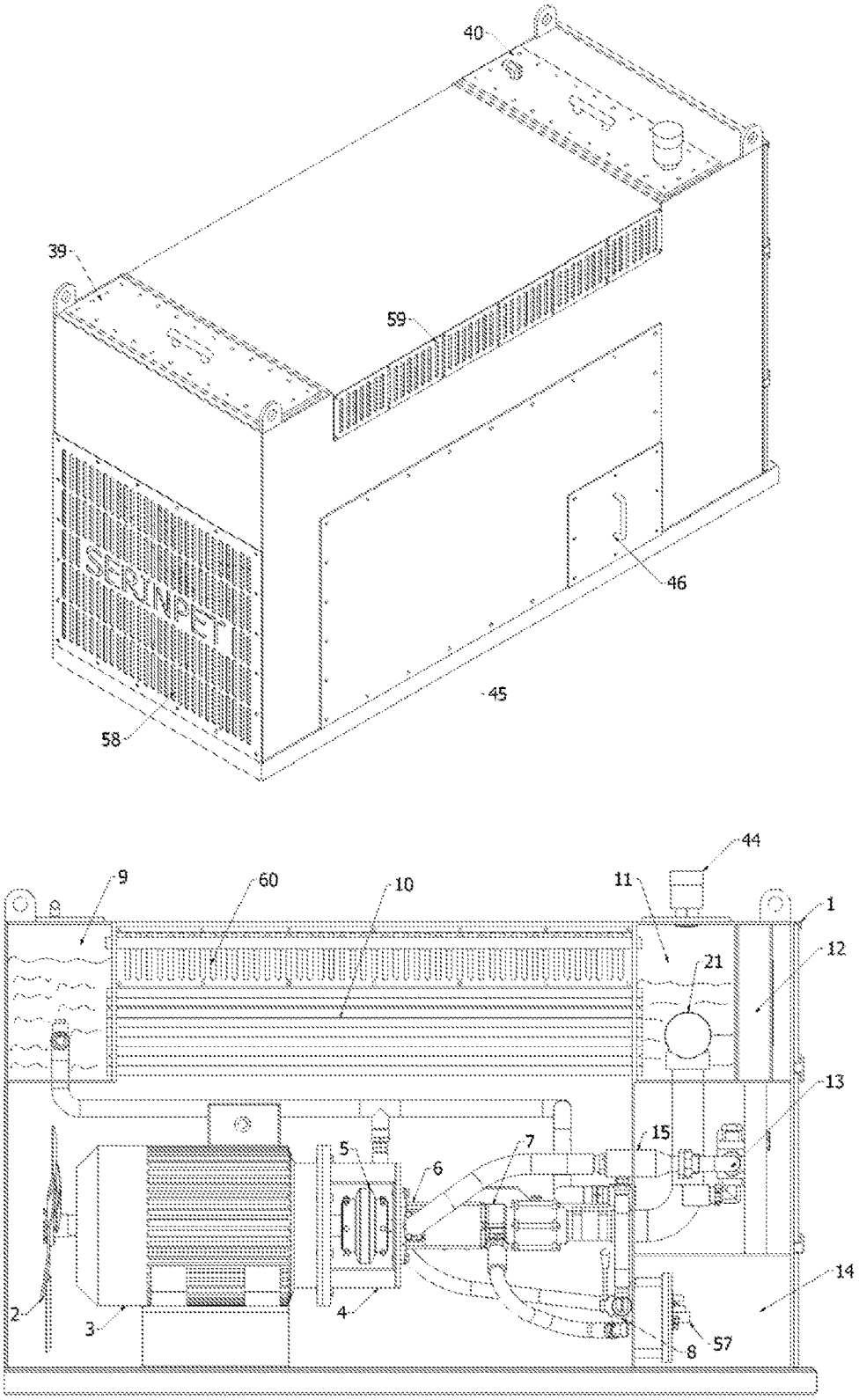
FIG. 4: is a perspective view of the hydraulic power unit and lateral view of the hydraulic power unit where oil levels can be observed inside the oil discharge tank 9 and the suction tank 11, as well as internal components of the machine.
Figure 5:
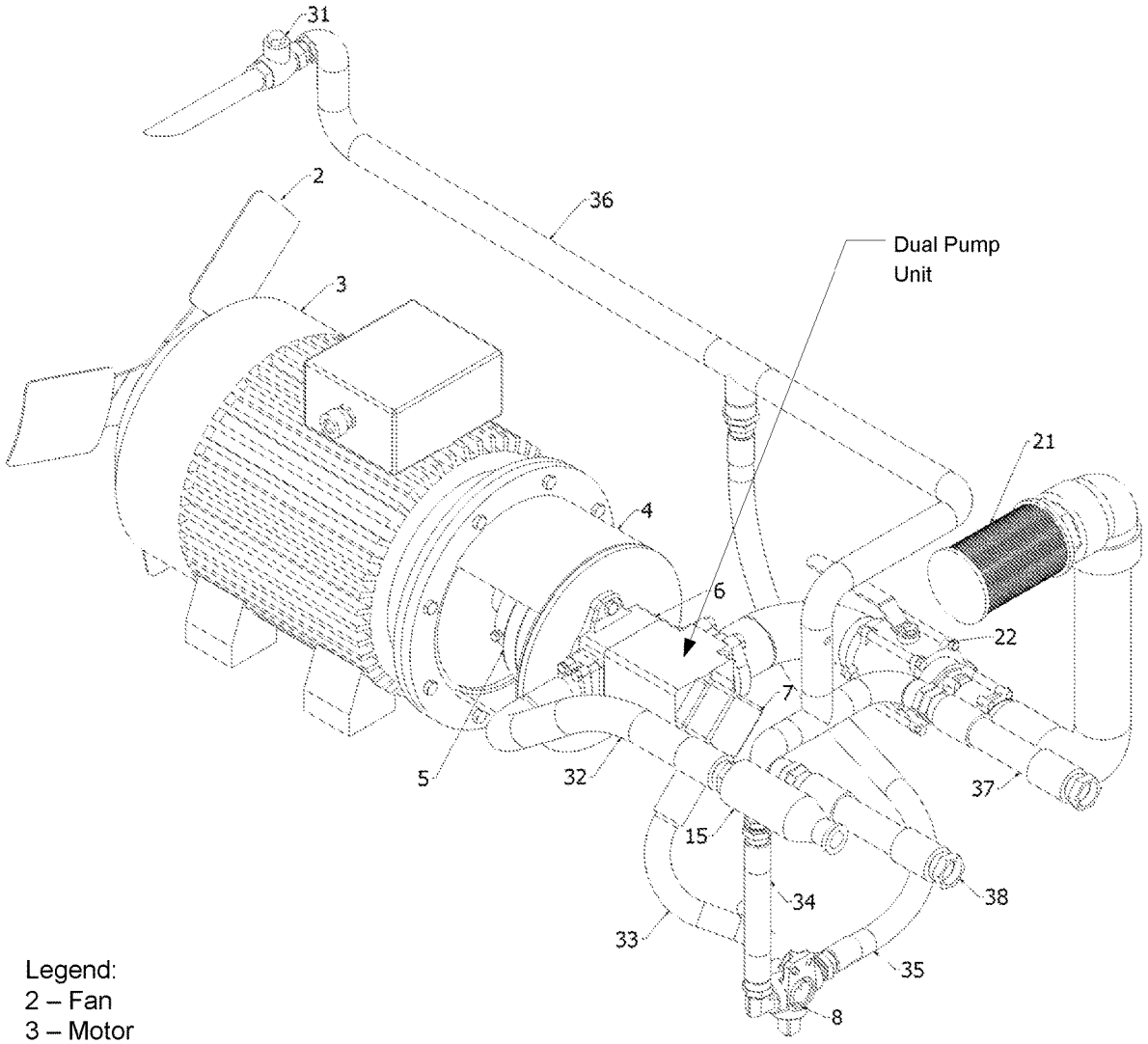
FIG. 5: is a perspective view of the hydraulic power unit motor where the suctions and discharge of the primary 6 and secondary 7 hydraulic pumps can be observed.
Figure 6:
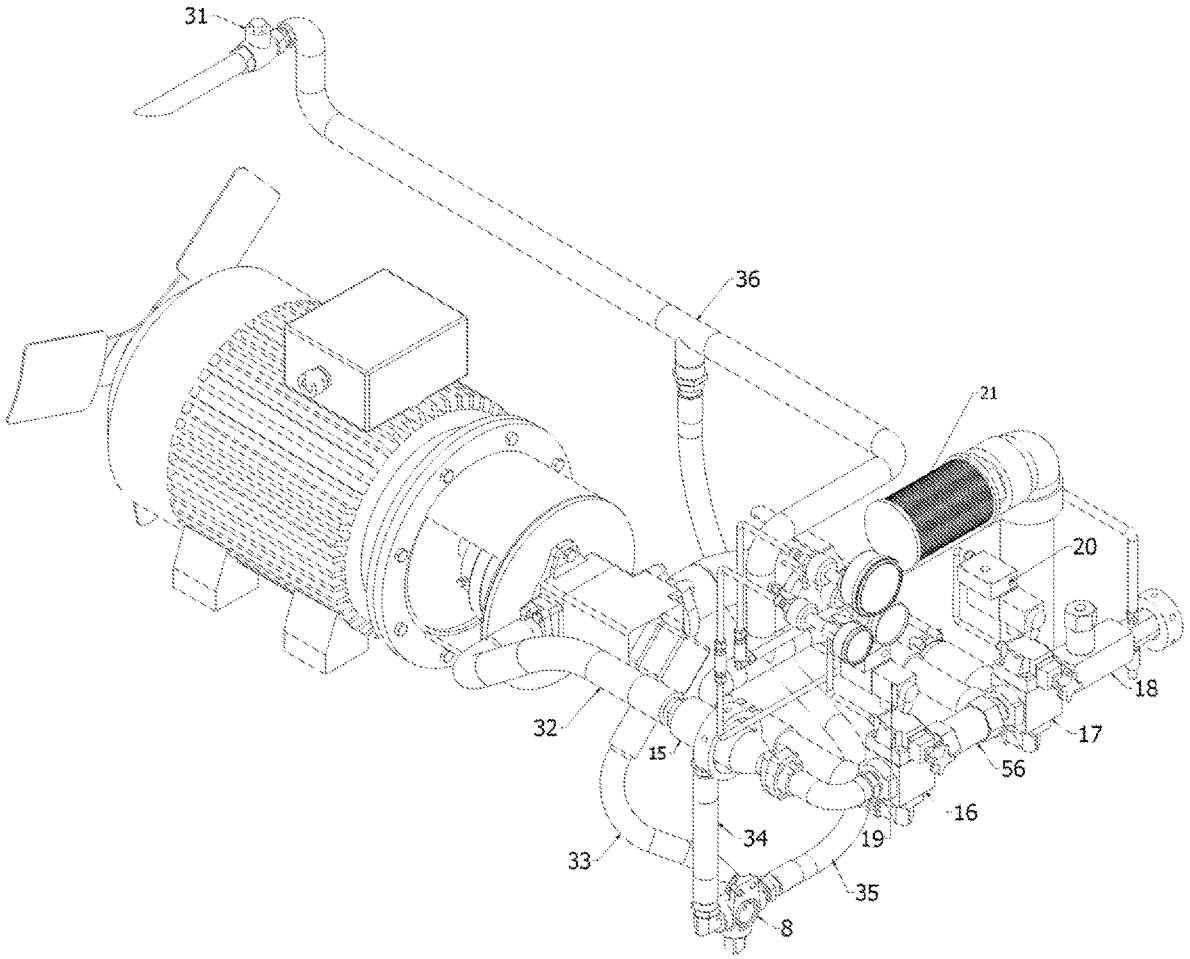
FIG. 6: is a perspective view of the hydraulic power circuit that is connected to the suctions and discharges from primary 6 and secondary 7 pumps.
Figure 7:
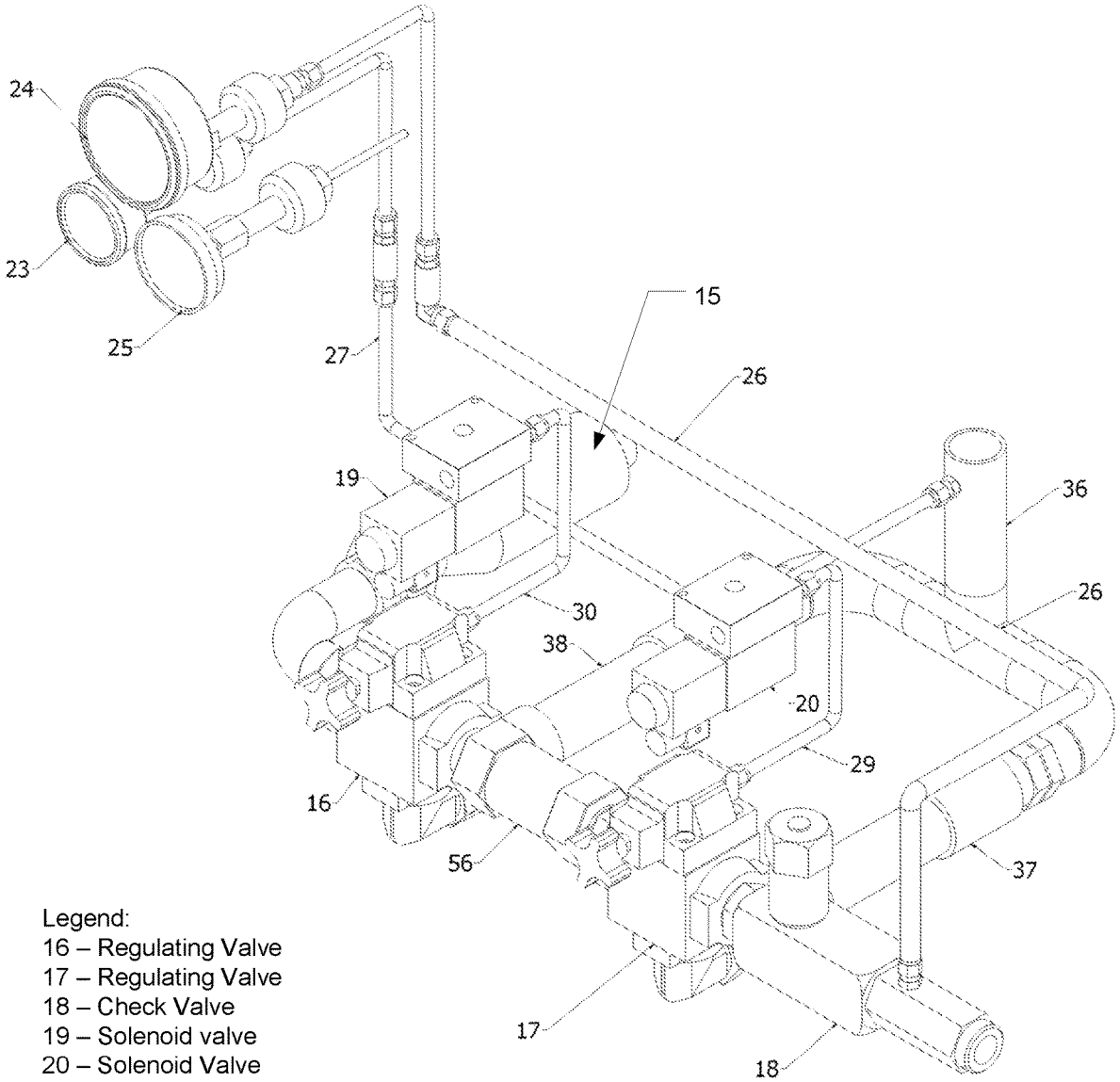
FIG. 7: is a perspective view of the hydraulic power circuit.

1. Chassis
2. Fan
3. Motor
4. Bell
5. Flexible Coupling
6. Primary pump
7. Secondary pump
8. Selector valve
9. Oil discharge tank
10. Radiator
11. Suction tank
12. Dry breech for electrical controls and measurement hydraulic elements
13. Coffer for hydraulic power circuit
14. Coffer for electrical components
15. Caudal Connector
16. Pressure control valve for the oil recirculation
17. Pressure control valve for the oil return
18. Flow regulating check valve
19. Primary pilot solenoid valve
20. Secondary pilot solenoid valve
21. Suction filter of hydraulic oil
22. Ball valve
23. Pressure Gauge recirculation circuit
24. Pressure gauge power circuit
25. Thermometer
26. Connection line between power circuit and manometer 24
27. Connection line between the return line 36 and the manometer 23
28. Viewer and level sensor 28
29. Connection line between the pilot solenoid valve 20 and the regulator valve 17
30. Connection line between the pilot solenoid valve 19 and the flow control valve 16
31. Check backstop
32. Hose 32 for connection between the primary pump 6 and the flow connector 15
33. Hose 33 for connection between the secondary pump 7 and selector valve 8
34. Hose 34 for connection between the valve 8 and the flow connector 15
35. Hose 35 for connection between valve 8 and the return line 36
36. Return line for the hydraulic oil
37. Hose connection between the pressure regulator valve 17 and return line 36
38. Hose connection between pressure regulator valve 16 and return line 36
39. Tank top return
40. Tank top of the oil suction
41. Cover for dry breech 12
42. Cover for coffer 13
43. Cover for coffer 14
44. Air filter 44
45. Lateral cover 45
46. Hatch 46
47. Pedestal 47
48. Hydraulic actuator
49. Superior Sensor
50. Inferior Sensor
51. Electrical control panel
52. Ball valve of high pressure
53. Hose for connect the hydraulic power circuit with the ball valve of high pressure 52
54. Hose to connect the pedestal 47 to the hydraulic actuator 48
55. Return line to connect the hydraulic actuator 48 to the suction tank 11
56. Check valve for high pressure
57. Electronic control card
58. Suction rack

59. Rack left side discharge
60. Rack right side discharge

The invention claimed is:

1. A hydraulic pumping apparatus comprising:

an enclosure with a lower section and an upper section;

said upper section of said enclosure comprising:

a suction tank coupled at a first end of said enclosure at said upper section;

a discharge tank coupled at an opposing end of said enclosure at said upper section;

a radiator forming an integral part of said enclosure and coupling the suction tank and the discharge tank;

an outlet vent located between the suction tank and the discharge tank and above the radiator;

said lower section of said enclosure comprising:

a motor comprising a shaft having a front end and a rear end;

an inlet vent at the first end of said enclosure;

a fan coupled to the rear end of the shaft and configured to suck external air into said enclosure through said inlet vent;

a dual pump unit coupled to the front end of the shaft of the motor, wherein the dual pump unit comprises a single suction fluidly coupled to the suction tank via a ball valve, wherein the dual pump unit comprises a primary pump and a secondary pump, wherein the primary pump's output is fluidly coupled to a flow connector and the secondary pump's output is fluidly coupled to a selector valve, wherein the selector valve is configured to selectively direct flow from said secondary pump to either the flow connector thereby summing the primary pump's output with the secondary pump's output or to the discharge tank; and a hydraulic power circuit coupled to the flow connector.

* * * * *